US006879141B1

(12) United States Patent
Ho

(10) Patent No.: US 6,879,141 B1
(45) Date of Patent: Apr. 12, 2005

(54) TEMPERATURE COMPENSATED VOLTAGE SUPPLY CIRCUIT

(75) Inventor: Jih-Shin Ho, Kaohsiung (TW)

(73) Assignee: King Billion Electronics Co., Ltd., Hsinchu Hsien (TW)

( * ) Notice: Subject to any disclaimer, the term of this patent is extended or adjusted under 35 U.S.C. 154(b) by 35 days.

(21) Appl. No.: 10/673,606

(22) Filed: Sep. 29, 2003

(51) Int. Cl.[7] ..... G05F 3/16
(52) U.S. Cl. ..... 323/315; 327/513; 327/543
(58) Field of Search ..... 323/314, 315, 323/316, 907; 327/539, 540, 543, 513

(56) References Cited

U.S. PATENT DOCUMENTS 5,859,560 A * 1/1999 Matthews ..... 327/513
6,351,111 B1 * 2/2002 Laraia ..... 323/315
6,724,243 B2 * 4/2004 La Rosa ..... 327/543

* cited by examiner

*Primary Examiner*—Shawn Riley
(74) *Attorney, Agent, or Firm*—Alan D. Kamrath; Nikolai Mersereau, P.A.

(57) ABSTRACT

A temperature compensated technique and circuit can be realized through the generation of a temperature compensated output voltage (Vnew) provided after summing the temperature coefficients (TC1,TC2) of two base voltages (VTC1, VTC2) assigned with different weights (a, b) and producing a new temperature coefficient (TCnew). This TCnew satisfies the expression: TCnew=TC1+a×(TC2−TC1), where the assigned weighted value (a) can be either a positive or a negative value, depending on the requirement of a circuit, in order to develop voltage supply suitable for wider applications.

13 Claims, 8 Drawing Sheets

TEMPERATURE COMPENSATED VOLTAGE SUPPLY CIRCUIT

BACKGROUND OF THE INVENTION

1. Field of the Invention

The present invention relates to a temperature compensated voltage supply circuit, in particular to a technique and circuit to develop a temperature compensated voltage from two or more base voltages having different temperature coefficients without using complicated modulation processes and to convert a positive temperature coefficient to a negative temperature coefficient to suit wider applications.

2. Description of Related Arts

In circuit designs, a reference voltage is often an input voltage that is invariant to changes in temperature, which means the temperature coefficient (TC) of the reference voltage has a zero value, where the temperature coefficient (TC) can be defined by the expression:

$$TC = \frac{\frac{F(T2) - F(T1)}{F(T0)}}{T2 - T1}$$

Where:

F( ) function represents a parameter, which is a voltage in the present example;

$T_0$, $T_1$, and $T_2$ represent different temperature values, and $T_0$ is a reference temperature; and $F(T_0)$, $F(T_1)$, and $F(T_2)$ represent three voltages having three different temperatures.

However for certain special requirements, the voltage value is expected to vary in accordance with any temperature variation (in which case the temperature coefficient is not a zero value), and the temperature coefficient needs to be controllable. The most important point is that the output voltages at the reference temperature ($T_0$) must always be the same even with different temperature coefficients. With reference to FIG. 7, the characteristic curves of two different temperature coefficients ($TC_1$, $TC_2$) show that $TC_1$ value eventually exceeds $TC_2$, but their output voltages are all equal to $V_0$ at the reference temperature $T_0$.

This circuit design is commonly found in the liquid crystal display (LCD) devices. Since a LCD device is generally sensitive to temperature, the control voltage has to be precise to match the changes in temperature for the precision operation in an LCD device.

With reference to FIG. 8, a bandgap reference circuit can be used to control the temperature coefficient by limiting the current passing through a diode, represented by the following expression:

$$I = I_o \times e^{\frac{V}{\frac{KT}{q}}} = I_o \times e^{\frac{qV}{KT}}$$

where the output current $I_{out}$ can be expressed as:

$$I_{out} = \frac{KT}{q} \times \frac{\ln(N)}{R}$$

where N represents the proportion of diode contacting areas between two diodes (D1, D2); their output voltages $V_{out}$ can be represented as:

$$V_{out} = V_{diode} + \frac{R1}{R} \times \frac{KT}{q} \times \ln(N)$$

where $V_{diode}$ represents the voltage value across two ends of diode (D3).

In this model, the output voltage tends to decrease as the temperature rises, but the constant KT/q will increase along with the temperature. Using their complementing characteristics, a suitable reference voltage $V_0$ can be obtained when the temperature is equal to $T_0$.

On the other hand, when the ratio between two resistors (R1/R) is changed, the output voltage $V_{out}$ will also be changed, which means the temperature coefficient can be used to control the output voltage $V_{out}$.

in, With reference to FIG. 9, the following example employs four bandgap reference circuits to generate output voltages with different temperature coefficient (TC1~TC4). A multiplexer is used to select a particular bandgap reference circuit based on the actual temperature requirement. The output voltage is temperature compensated, and the output voltage is always equal to the reference voltage ($V_0$) at a reference temperature $T_0$. The main disadvantage of using this technique is that these bandgap reference circuits occupy a large space in the integrated circuit and consume considerable power. Therefore, under the precondition that the output voltage has to be equal to the reference voltage ($V_0$) at a reference temperature $T_0$, the most difficult task is finding suitable components having different temperature coefficients to produce different output voltages. This poses a challenge for fabrication of the present day semiconductor.

With reference to FIG. 10, another example of a bandgap reference circuit is based on the design described in the previous example, but the two bandgap reference circuits are connected in parallel in this example respectively with output voltages V1 and V2. To generate voltage values having different temperature coefficients, two diodes (D1, D2) are used, which are built with somewhat different processes to produce the necessary temperature characteristics. Unfortunately, this modulation process cannot be implemented in actual chip fabrication.

With reference to FIG. 11, another conventional bandgap reference circuit uses a single bandgap reference circuit to generate four different output voltages (V1~V4) having different temperature coefficients. However, the output voltages (V1~V4) are not equal at temperature $T_0$, thereby four level conversion circuits are required for tuning the output voltages (V1~V4) to make the voltage values (VTC1~VTC4) converge at temperature $T_0$. After the conversion by the level conversion circuit, the output voltages (V1~V4) can then be defined as follows:

$$VTC_n = a_n \times V_n + b_n, \text{ where } n=14.$$

With reference to FIG. 12, still another bandgap reference circuit, is largely based on the previous design, but only two voltage outputs (V1,V2) are generated instead of four. These two output voltages are obtained from two resistors (R1,R2) connected in series. Using the same design logic, four resistors must be connected in series if four output voltages are needed.

The biggest drawback in the above design is that the level conversion circuit will complicate the circuit design, which not only takes up more space in circuit design but also uses more power. Furthermore, the temperature coefficient of each output voltage after the level conversion is also likely to be changed.

SUMMARY OF THE INVENTION

The main objective of the present invention is to provide a method and circuit for developing temperature compensated voltage supply based on two or more base voltages having different temperature coefficients, and also to convert a positive temperature coefficient to a negative temperature coefficient in the voltage modulation process for wider applications.

The method comprises the steps of:

generating a first base voltage (VTC1) and a second base voltage (VTC2), where the first base voltage (VTC1) and the second base voltage (VTC2) have different temperature coefficients (TC1, TC2) and have the same voltage value at a reference temperature $T_0$;

generating an output voltage (Vnew), based on the first base voltage (VTC1) and the second base voltage (VTC2) assigned with different weighted values (a,b), and this output voltage (Vnew) must satisfy the following expression:

$$Vnew=a\times VTC2+b\times VTC1$$

where the output voltage (Vnew) possesses a new temperature coefficient (TCnew); and the two weighted values (a,b) have to satisfy the conditions: a+b=1, and $0\leqq|a|$, $1\geqq|b|$.

The temperature coefficient (TCnew) must satisfy the expression:

$$TCnew=TC1+a\times(TC2-TC1).$$

In actual implementation, the circuit for the present invention includes:

a base voltage generator for generating two different base voltages having different temperature coefficients (T1, T2), and these two or more base voltages must exhibit the same voltage value at the reference temperature;

a output voltage generator for generating an output voltage after summing the two base voltage values, where the output voltage possesses a new temperature coefficient (TCnew) derived from the temperature coefficients (T1,T2) of the two base voltages, and the TCnew has to satisfy the expression:

$$TCnew=TC1+a\times(TC2-TC1).$$

The features and structure of the present invention will be more clearly understood when taken in conjunction with the accompanying drawings.

DETAILED DESCRIPTION OF THE PREFERRED EMBODIMENT

The present invention provides a circuit and method for developing a temperature compensated voltage supply, which use two base voltages having different temperature coefficients. The output voltage has a new temperature coefficient. The operating principle behind the present invention first sets up a first base voltage (VTC0) and a second base voltage (VTC) having different temperature coefficients. The temperature coefficient (TC1) of the first base voltage (VTC0) is always equal to zero, which means the first base voltage (VTC0) is a constant value invariant to changes in temperature. The second base voltage (VTC) is equal to the first base voltage (VTC0) when the reference temperature ($T_0$) is reached, which can be represented by the first expression:

$$VTC=VTC0\times[1+TC\times(T-T_0)] \quad (1)$$

Thereafter, an output voltage (Vnew) is generated using the first base voltage (VTC0) and the second base voltage (VTC), as defined by the second expression:

$$Vnew=a\times VTC+b\times VTC0 \quad (2)$$

where parameters (a, b) represent weighted values assigned to the first base voltage (VTC0) and the second base voltage (VTC), and these two weights shall satisfy the conditions: a+b=1, $0\leqq|a|$, $1\geqq|b|$.

By rearranging the above two expressions and adding a new condition a+b=1, the actual output voltage (Vnew) can be expressed as:

$$Vnew=VTC0\times[1+a\times TC\times(T-T_0)] \quad (3)$$

By comparing the first and third expressions, the temperature coefficient of the output voltage (Vnew) will become TCnew, when the temperature coefficient is equal to a×TC: TCnew=a×TC That a new temperature coefficient can be created just by changing the value (a) is apparent from the above description, and if the value (a) is negative, then a new temperature coefficient with negative value is produced. The hardware implementation of the present invention comprises a base voltage generator and an output voltage generator. The base voltage generator generates two base voltages having different temperature coefficients (T1, T2), where the two base voltages are equal at the reference temperature ($T_0$). The output voltage generator generates an actual output voltage after summing the two base voltages assigned different weights. The temperature coefficient (TCnew) of the output voltage is determined by the temperature coefficients (T1, T2) of the two base voltages.

Figure 1:
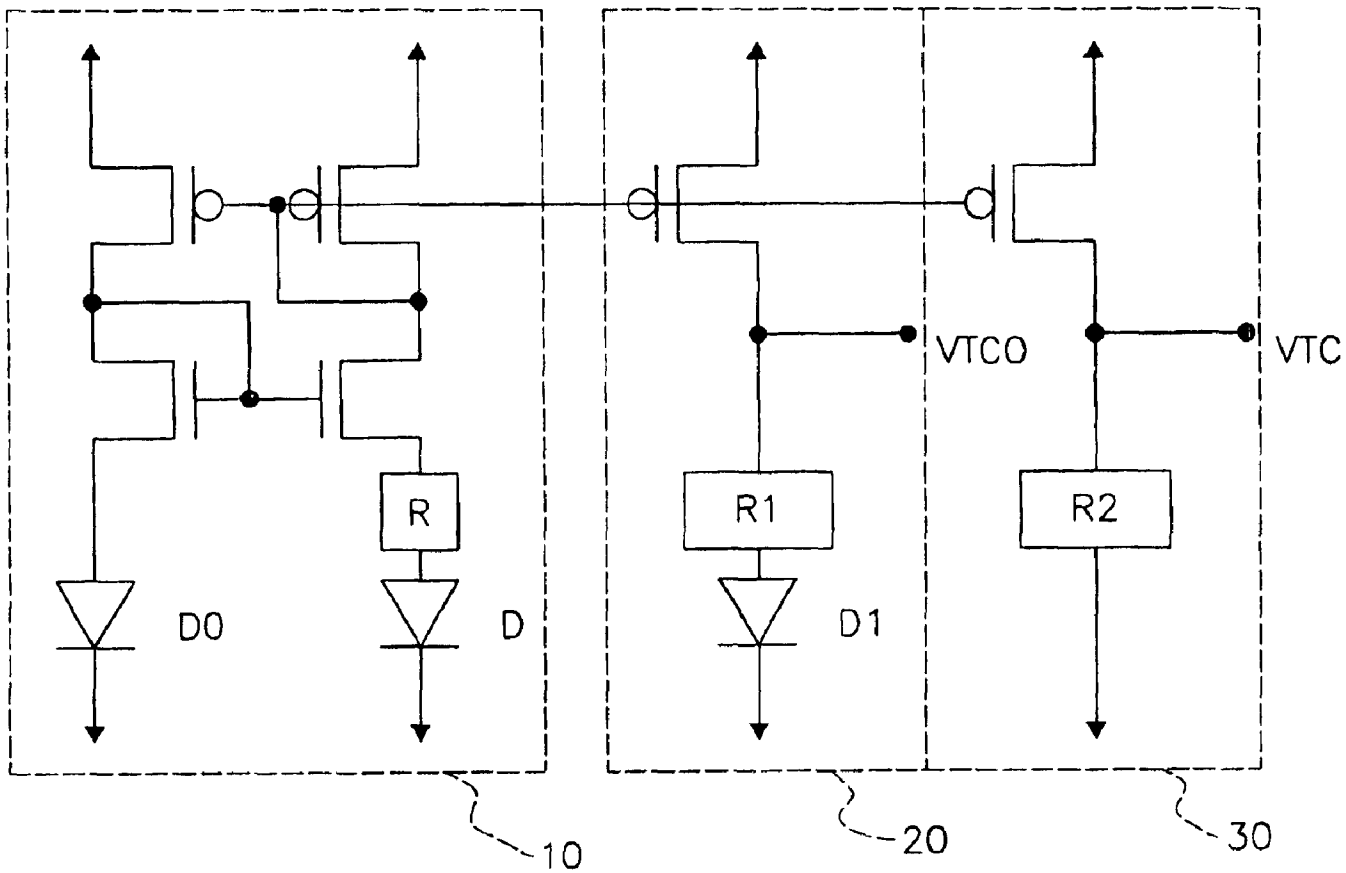
FIG. 1 is a circuit diagram of a base voltage generator that employs two base voltages with different temperature coefficients to generate an output voltage in accordance with the present invention.

With reference to FIG. 1, an actual implementation of the base voltage generator for the present invention generates the first base voltage (VTC0) and the second base voltage (VTC) and includes a current mirror (10), a first output circuit (20) and a second output circuit (30). The current mirror (10) has an output side and an input side. The output side is connected to a resistor (R) and a diode (D) connected in series. The input side has a diode ($D_0$), The diodes (D, $D_0$) respectively have contact areas. The contact area of the diode (D) on the output side is N times greater than the contact area of the diode ($D_0$) on the input side. The first output circuit (20) has an input, a resistor (R1), a diode (D1) and an output. The input is connected in parallel to the output of the current mirror (10) and to a resistor (R1) and a diode (D1) connected in series. The resistor (R1) has an inside end and an outside end. The outside end is connected to the diode (D1), and the inside end is an output node for the first base voltage (VTC0). The second output circuit (30) has an input, a resistor (R2) and an output. The input is connected in parallel to the output of the current mirror (10) and in series to the resistor (R2). The resistor (R2) has an inside end and an outside end. The inside end is an output node for the second output voltage (VTC).

To fulfill the above circuit requirements, the ratio of the two resistors (R1, R) has to be adjusted to make the temperature coefficient of the first base voltage (VTC0) equal a zero value to produce a constant voltage value. Then, the resistance of resistor (R2) is adjusted to make the second base voltage (VTC) equal to the first base voltage (VTC0) when the temperature is $T_0$, that is $VTC(T_0)=VTC0$.

Figure 2:
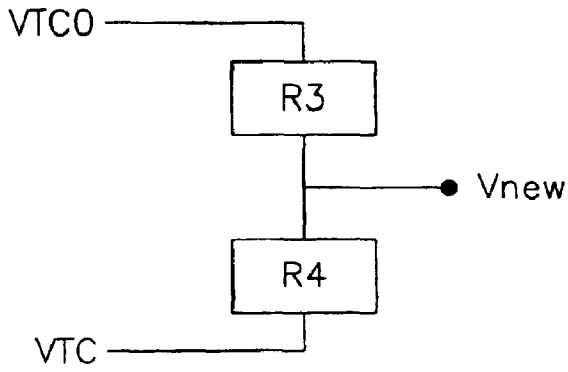
FIG. 2 is a block diagram of an output voltage generator using two base voltages to generate an output voltage.

With reference to FIG. 2, an actual implementation of the output voltage generator obtains an actual output voltage (Vnew) from two base voltages (VTC, VTC0). In this example, two resistors (R3, R4) connected in series are used as a voltage divider to generate an output voltage (Vnew), where the ratio between two resistors (R3, R4) depends on the parameter (a) in the third expression. Therefore, when the ratio between these two resistors is changed, a different temperature coefficient can be obtained. The main advantage of this design is its simplicity, but the temperature coefficient so obtained still possesses the same positive and negative characteristics as the base voltages (VTC0, VTC). Therefore, a positive voltage value cannot be converted to a negative voltage value in this case.

Figure 3:
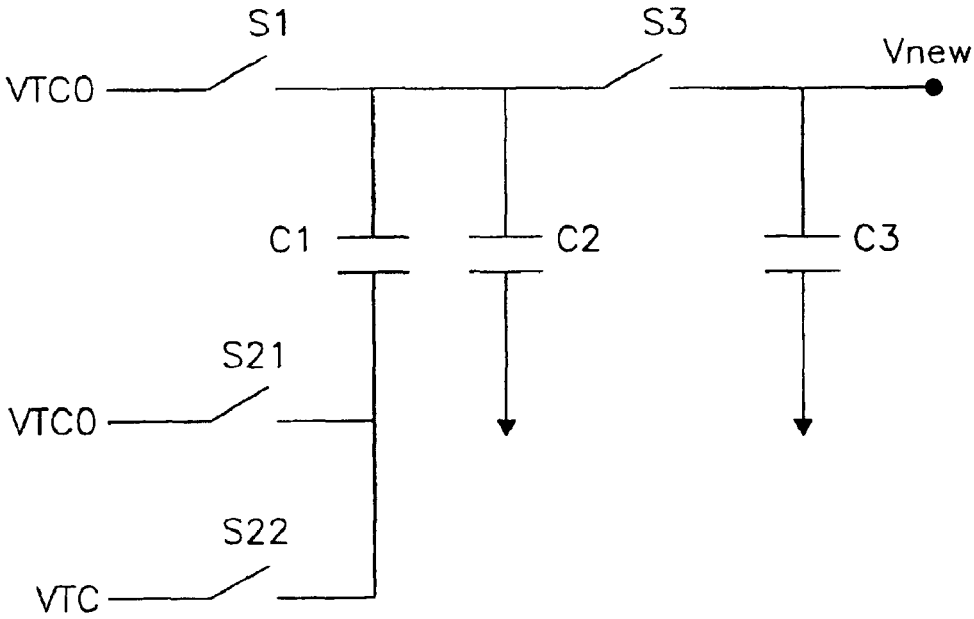
FIG. 3 is another implementation of the output voltage generator using capacitor switching to modulate the temperature coefficients.

With reference to FIG. 3, another method for generating an actual output voltage (Vnew) uses capacitor switching. The circuit employs four switches (S1, S3, S21, and S22) and three capacitors (C1~C3). The first capacitor (C1) has two ends that are respectively connected to switches (S1, S21) leading to a first base voltage (VTC0), and one end is also connected to a second base voltage (VTC) through another switch (S22).

The second and third capacitors (C2, C3) are connected in parallel to the first capacitor (C1), with a switch (S3) mounted between the second and third capacitors (C2, C3). One end of the third capacitor (C3) becomes a node for output voltage.

Figure 4:
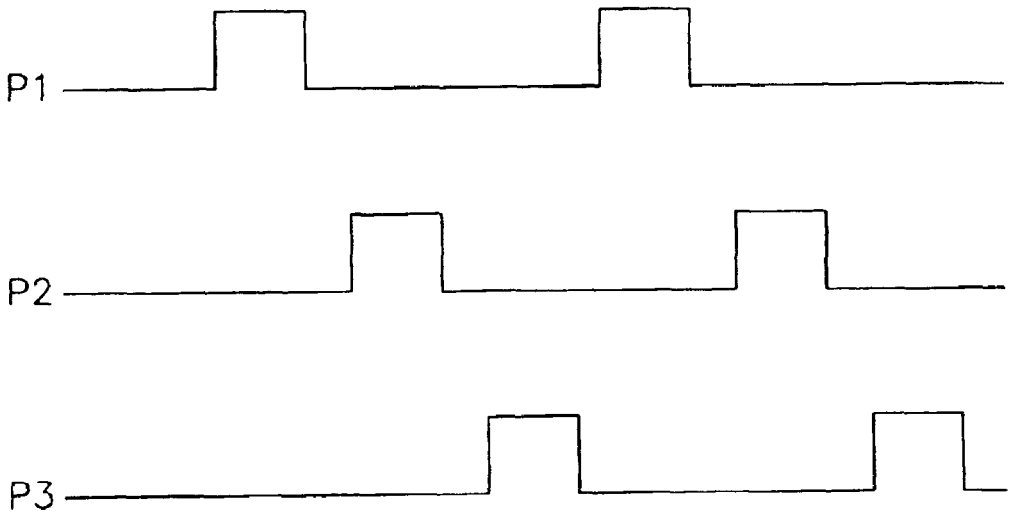
FIG. 4 is a timing diagram of clock waveforms for controlling the switches used in FIG. 3.

With reference to FIG. 4, a clock sequence with three non-overlapping clock signals (P1–P3) controls the operation of the four switches (S1, S3, S21, and S22).

Determining whether the positive and negative values of the new temperature coefficient are to be the same or different from the original temperature coefficients is possible with this capacitor switching technique. (a) The values of the temperature coefficient on the output voltage (Vnew) and the original temperature coefficients on the first and second base voltages are both positive or both negative when the clock signals (P1–P3) for the switches (S1, S3, S21, and S22) are:

S1=P1

S3=P3

S21=P1

S22=P2.

(b). The values of the temperature coefficient on the output voltage (Vnew) and the original temperature coefficients on the first and second base voltages are positive and negative (i.e. opposite signs) when the clock signals (P1–P3) for the switches (S1, S3, S21, and S22) are:

S1=P1

S3=P3

S21=P2

S22=P1.

By changing the ratio between the two capacitors (C1, C2), which generates a different weighted value (a), the output voltage (Vnew) can be made to have a new temperature coefficient value.

Figure 5:
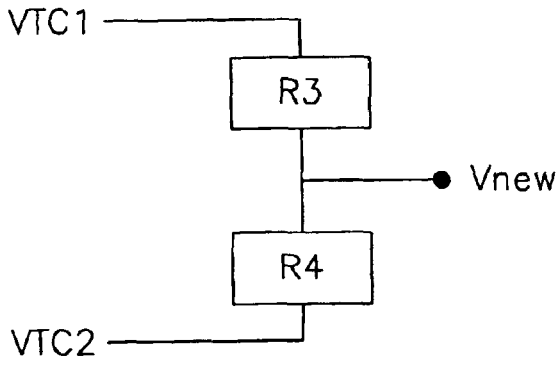
FIG. 5 is another embodiment of the invention.

With reference to FIG. 5, another embodiment of the present invention has a first base voltage (VTC1) and a second base voltage (VTC2) with individual temperature coefficients (TC1, TC2) not equal to zero, and the first and second base voltages (VTC1, VTC2) must be the same at a reference temperature $T_0$. The new temperature coefficient (TCnew) on the output voltage (Vnew) can be expressed as follows:

$$TCnew=TC1+a\times(TC2-TC1).$$

Figure 6:
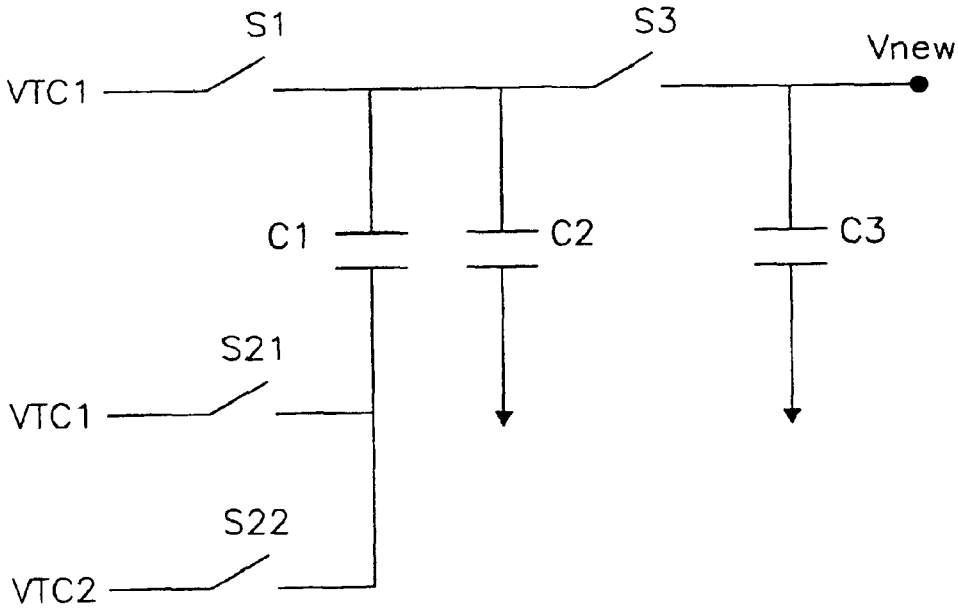
FIG. 6 is a schematic of the circuit that uses capacitor switching to modulate the temperature coefficients in accordance with the present invention.
Figure 7:
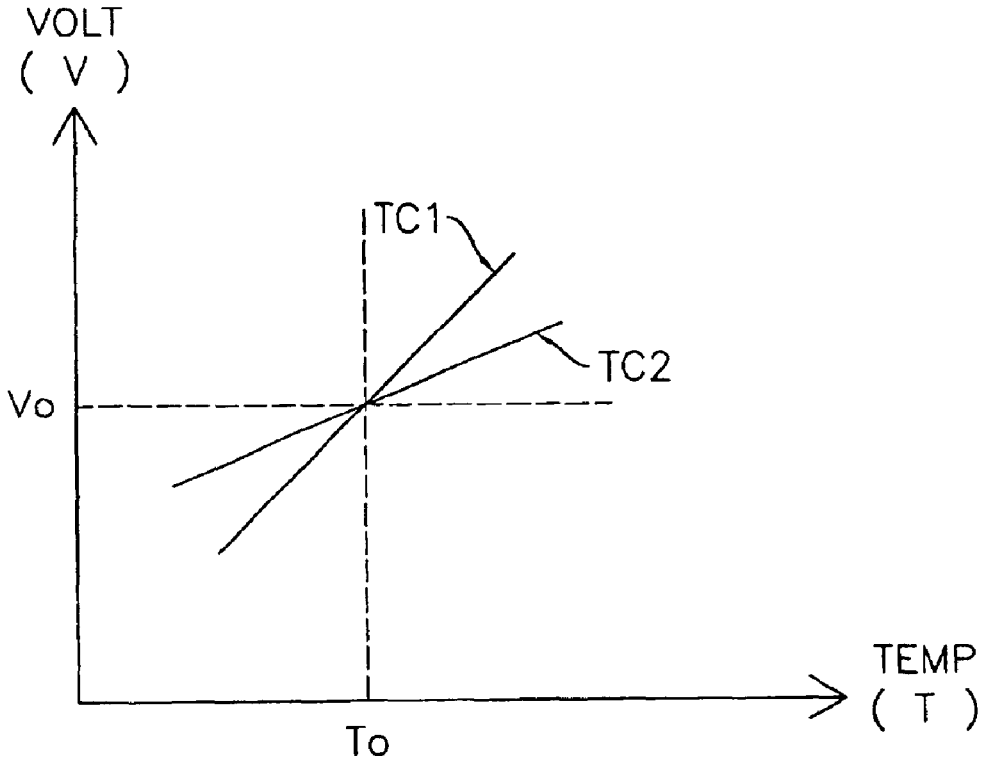
FIG. 7 PRIOR ART
FIG. 7 is a characteristic curve of two base voltages with different temperature coefficients.
Figure 8:
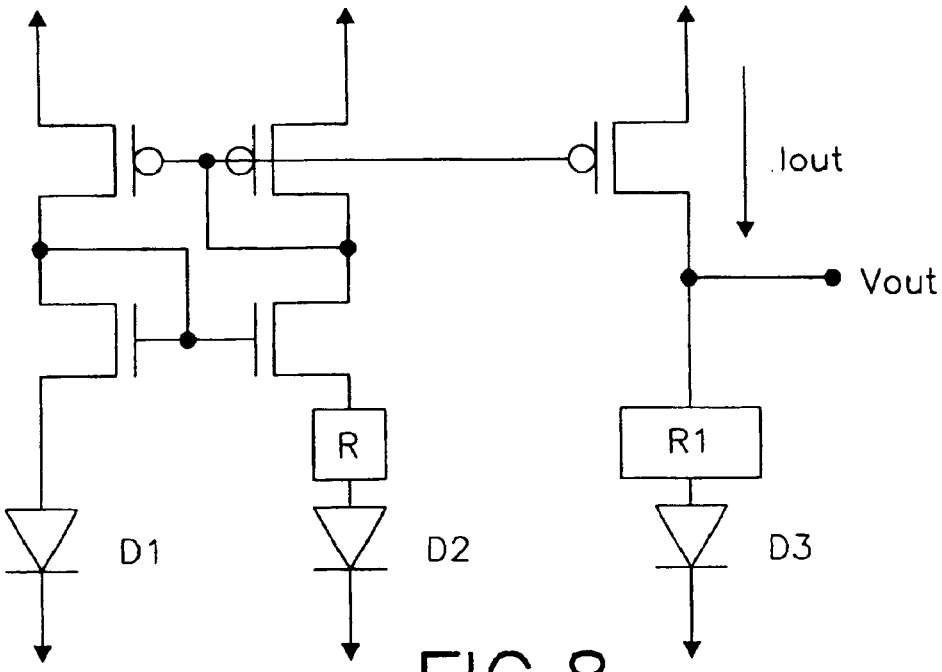
FIG.8 PRIOR ART
FIG. 8 is a schematic of a conventional bandgap reference circuit.
Figure 9:
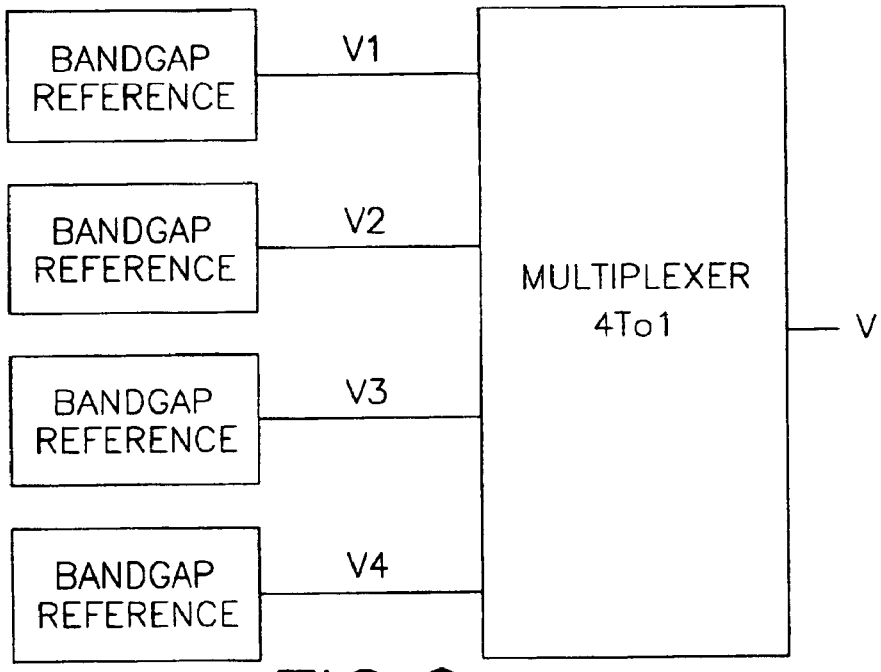
FIG.9 PRIOR ART
FIG. 9 is a block diagram of a conventional voltage supply circuit through modulation of temperature coefficients.
Figure 10:
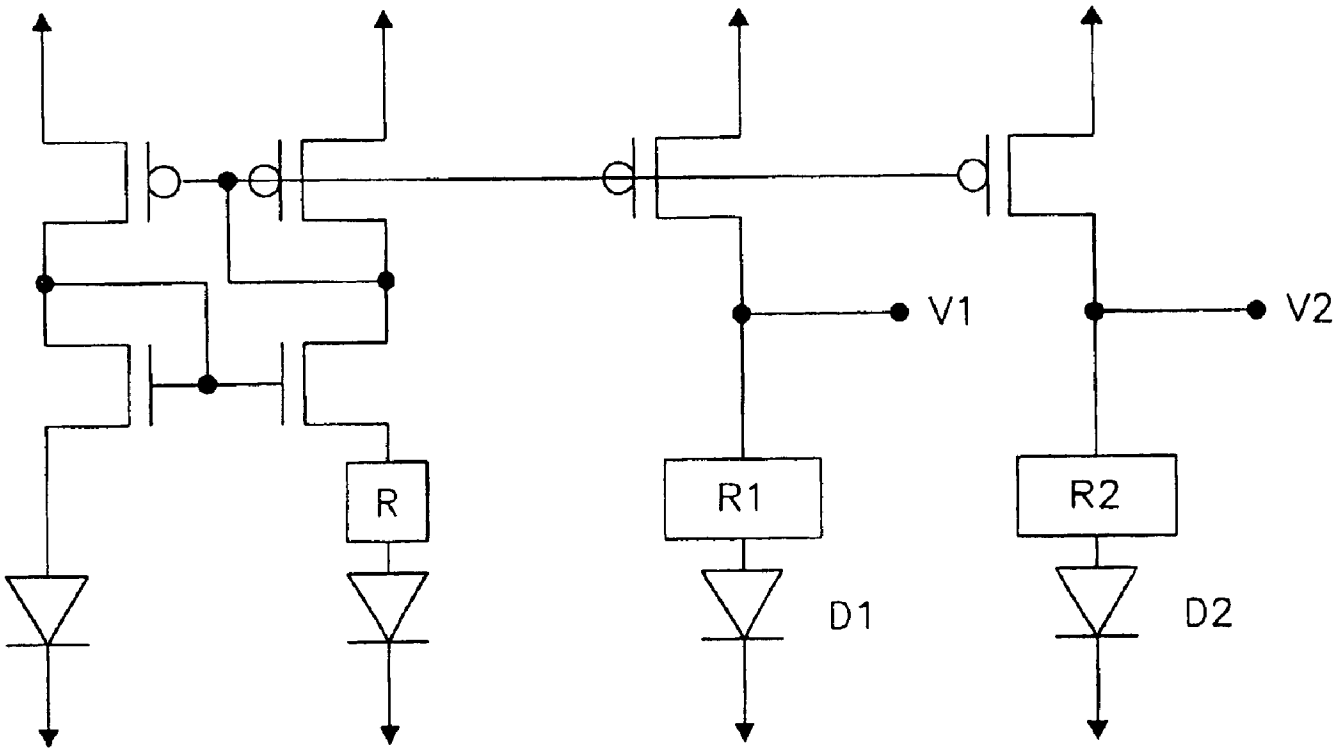
FIG. 10 PRIOR ART
FIG. 10 is a detailed circuit diagram of the bandgap reference circuit in FIG. 8.
Figure 11:
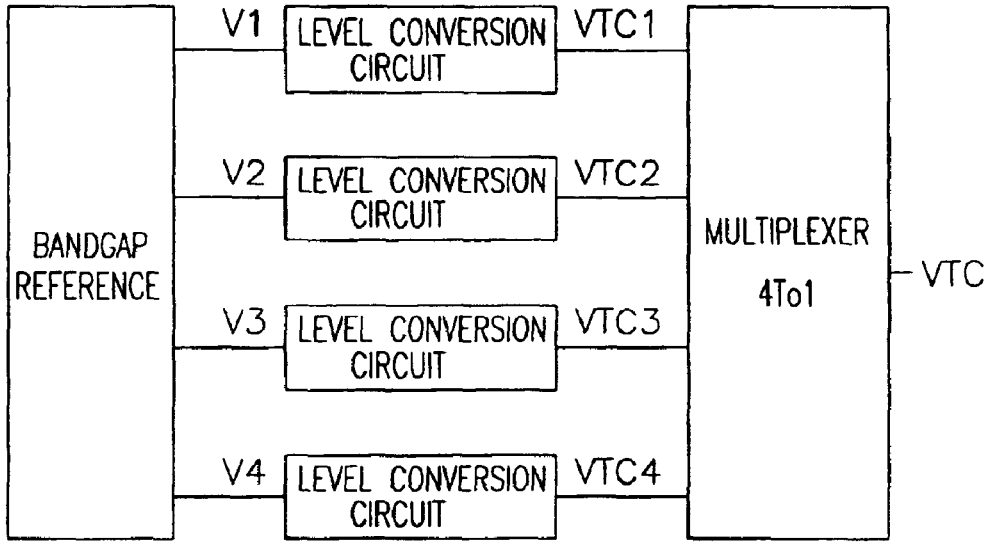
FIG. 11 PRIOR ART
FIG. 11 is a block diagram of another conventional voltage supply circuit through modulation of temperature coefficients.
Figure 12:
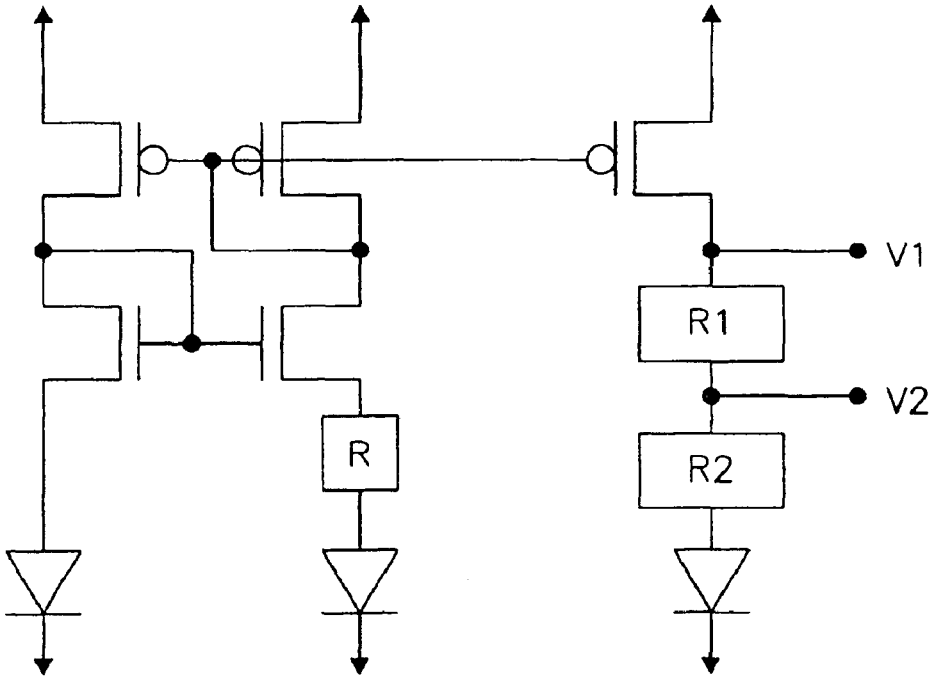
FIG. 12 PRIOR ART
FIG. 12 is a detailed circuit diagram of the bandgap reference circuit in FIG. 10.

With reference to FIG. 6, the resistive circuit can be modified by implementing the previously described capacitor switching technique, where the switches (S1, S3, S21, and S22) use the same clock signals (P1–P3) previously described to control the switching to generate either a positive or negative temperature coefficient.

From the foregoing, the circuit design of the present invention is much simpler than the conventional methods, by summing two base voltages with variable temperature coefficients to generate an output voltage. The voltage supply circuit also takes up less space and consumes less power.

The foregoing description of the preferred embodiments of the present invention is intended to be illustrative only and, under no circumstances, should the scope of the present invention be so restricted.

What is claimed is:

1. A method for developing a temperature compensated voltage supply comprising the steps of:

generating a first base voltage (VTC1) and a second base voltage (VTC2), wherein the first base voltage (VTC1) and the second base voltage (VTC2) have unique temperature coefficients (TC1, TC2);

generating an output voltage (Vnew) by summing the first base voltage (VTC1) and the second base voltage (VTC2) assigned with different weights (a,b), such that the new output voltage Vnew has a new temperature coefficient TCnew; and this output voltage (Vnew) satisfies the expression:

$$Vnew=a\times VTC2+b\times VTC1,$$

where the above two weight values (a,b) shall satisfy the conditions: a+b=1, and $0\leqq|a|$, $1\geqq|b|$.

2. The method for developing a temperature compensated voltage supply as claimed in claim 1, wherein the new temperature coefficient (TC new) satisfies the expression:

$$TCnew=TC1+a\times(TC2-TC1).$$

3. The method for developing a temperature compensated voltage supply as claimed in claim 1, wherein the first base voltage (VTC1) and the second base voltage (VTC2) are equal when the temperature is $T_0$.

4. The method for developing a temperature compensated voltage supply as claimed in claim 2, wherein the first base voltage (VTC1) and the second base voltage (VTC2) are equal when the temperature is $T_0$.

5. The method for developing a temperature compensated voltage supply as claimed in claim 4, wherein the weighted value (a) can be negative.

6. The method for developing a temperature compensated voltage supply as claimed in claim 5, wherein the weighted value (a) can be negative.

7. A circuit for developing a temperature compensated voltage supply, comprising:

a base voltage generator for generating two base voltages (VTC1, VTC2) having different temperature coefficients (T1,T2), whereby the base voltages (VTC1, VTC2) are equal when the temperature is equal to the reference temperature, a zero value;

an output voltage generator for generating output voltage (Vnew) based on different weighted values (a, b) assigned to the two base voltages (VTC1, VTC2), wherein the output voltage generator is connected to an output of the base voltage generator, and the two weighted values (a, b) satisfy the conditions: a+b=1, and $0\leqq|a|$, $1\geqq|b|$; and the temperature coefficient (TCnew) of the actual output voltage (Vnew) is determined by the temperature coefficients (T1,T2) on the two base voltages (VTC1, VTC2), satisfying the expression $$TCnew=TC1+a\times(TC2-TC1).$$

8. The circuit for developing a temperature compensated voltage supply as claimed in claim 7, wherein the base voltage generator in the temperature compensated voltage supply circuit further includes:

a current mirror (10) having an output side connected by a resistor (R) and a diode (D) connected in series, and an input side has a diode ($D_0$), wherein a diode contact area of the diode (D) on the output side is N times greater than that of the diode ($D_0$) on the input side;

a first output circuit (20) having an input connected in parallel to an output of the current mirror (10), and in series to a resistor (R1) and a diode (D1), wherein one end of the resistor (R1) becomes an output node for the first base voltage (VTC0); and a second output circuit (30) having the input connected in parallel to the output of the current mirror (10), and connected in series to a resistor (R2), wherein one end of the resistor (R2) becomes an output node for the second output voltage (VTC).

9. The circuit for developing a temperature compensated voltage supply as claimed in claim 8, wherein the output voltage generator is formed by two resistors connected in series, and two ends are respectively connected to the two base voltages (VTC1, VTC2), and the junction where these two resistors are connected forms an output node for an output voltage (Vnew).

10. The circuit for developing a temperature compensated voltage supply as claimed in claim 9, wherein the weighted value (a) depends on the ratio between the two resistors.

11. The circuit for developing a temperature compensated voltage supply as claimed in claim 8, wherein the output voltage generator further includes four switches (S1, S3, S21, and S22) and three capacitors (C1~C3), wherein two ends of the first capacitor (C I) through the switches (S1, S21) are connected to an output node for the first base voltage (VTC 1), and one end of the first capacitor (C1) through the switch (S22) is connected to an output node for a second base voltage (VTC2);

the second and third capacitors (C2, C3) are connected in parallel to the first capacitor (C1), with a switch (S3) mounted between the second and third capacitors (C2, C3) for switching capacitors, where one end of the third capacitor (C3) becomes an output node for the output voltage (Vnew); and the four switches (S1, S3, S21, and S22) are controlled by three non-overlapping clock signals (P1)~(P3).

12. The circuit for developing a temperature compensated voltage supply as claimed in claim 11, wherein the clock signals for the four switches (S1, S3, S21, and S22) satisfy the following conditions:

S1=P1

S3=P3

S21=P1

S22=P2.

13. The circuit for developing a temperature compensated voltage supply as claimed in claim 11, wherein the clock signals for the four switches (S1, S3, S21, and S22) satisfy the following conditions:

S1=P1

S3=P3

S21=P2

S22=P1.

* * * * *